US005273952A

United States Patent [19]

Wehrmann et al.

[11] Patent Number: 5,273,952

[45] Date of Patent: Dec. 28, 1993

[54] DYE ACCEPTOR ELEMENT FOR THERMOSUBLIMATION PRINTING

[75] Inventors: Rolf Wehrmann, Krefeld; Herbert Hugl, Bergisch Gladbach; Dittmar Nerger, Krefeld, all of Fed. Rep. of Germany

[73] Assignee: Agfa Gevaert AG, Leverkusen, Fed. Rep. of Germany

[21] Appl. No.: 825,385

[22] Filed: Jan. 24, 1992

[30] Foreign Application Priority Data

Feb. 7, 1991 [DE] Fed. Rep. of Germany ..... 4103680

[51] Int. Cl.[5] ..... B41M 5/035; B41M 5/38

[52] U.S. Cl. ..... 503/227; 428/195; 428/412; 428/913; 428/914

[58] Field of Search ..... 8/471; 428/195, 412, 428/913, 914; 503/227

[56] References Cited

U.S. PATENT DOCUMENTS

| | | | |
|---|---|---|---|
| 3,945,926 | 3/1976 | Kesting | 210/500 |
| 4,069,151 | 1/1978 | Higley et al. | 128/214 |
| 4,075,108 | 2/1978 | Higley et al. | 210/500 |
| 4,160,791 | 7/1979 | Higley et al. | 525/469 |
| 4,607,070 | 8/1986 | Schreckenberg et al. | 524/100 |
| 4,705,522 | 11/1987 | Bayers | 8/471 |
| 4,927,803 | 5/1990 | Bailey | 503/227 |

FOREIGN PATENT DOCUMENTS

| | | | |
|---|---|---|---|
| 0227094 | 7/1987 | European Pat. Off. | 503/227 |
| 0228066 | 7/1987 | European Pat. Off. | 503/227 |
| 2251066 | 4/1973 | Fed. Rep. of Germany | 210/500 |
| 3408804 | 4/1985 | Fed. Rep. of Germany . | |

*Primary Examiner*—B. Hamilton Hess

*Attorney, Agent, or Firm*—Connolly and Hutz

[57] ABSTRACT

A dye acceptor element for thermosublimation printing comprising a support and a dye acceptor layer consisting essentially of polycarbonate arranged on the support, the polycarbonate containing 30 to 95% by weight aromatic carbonate structural units corresponding to formula I

[—O—diphen—O—CO—] (I)

in which diphen is the residue of a diphenol containing 6 to 30 and preferably 12 to 24 carbon atoms, and 70 to 5% by weight aliphatic polyether carbonate structural units corresponding to formula II

[—O—polyether—O—CO—] (II)

in which polyether is the residue of an aliphatic polyether diol having a molecular weight Mn of 600 to 20,000, is distinguished by high color density and a minimal tendency towards adhesion.

17 Claims, No Drawings

DYE ACCEPTOR ELEMENT FOR THERMOSUBLIMATION PRINTING

This invention relates to a dye acceptor element for thermosublimation printing.

Printouts of video- or computer-stored images can be made by a number of methods among which thermosublimation printing has proved to be superior for certain requirements by virtue of its advantages over other processes. In this recording method, a sheet-form or web-form donor material containing a sublimable dye is brought into contact with a dye acceptor layer and is heated imagewise to transfer the dye.

The thermohead is controlled and the dye transferred from the donor material to the acceptor element in accordance with the stored original. A detailed description of the process can be found, for example, in "High Quality Image Recording by Sublimation Transfer Recording Material", Electronic Photography Assocation Documents 27 (2), 1988 and in the literature cited therein. A particular advantage of this printing process is that it enables color intensities to be finely graduated.

Dye acceptor elements for thermosublimation printing usually comprise a support, for example paper or transparent films, which is coated with the actual dye acceptor layer. A binder layer can be arranged between the support and the acceptor layer.

Polymers of different classes may be used as the material for the dye acceptor layer.

Thus, the following examples of suitable materials for the acceptor layer are mentioned in EP-A-0 234 563:

1. synthetic resins containing ester compounds, such as polyester, polyacrylates, polyvinyl acetate, styrene/acrylate resins and vinyl toluene/acrylate resins
2. polyurethanes
3. polyamides
4. urea resins
5. synthetic resins containing other highly polar bonds, such as polycaprolactam, styrene resins, polyvinyl chloride, vinyl chloride/vinyl acetate copolymers and polyacrylonitrile.

Polycarbonate, polyurethane, polyester, polyvinyl chloride, poly(styrene-co-acrylonitrile), polycaprolactone and mixtures thereof are mentioned as materials for the dye acceptor layer in U.S. Pat. No. 4,705,522.

EP-A-0 228 066 describes a dye acceptor layer having improved light stability which contains a mixture of polycaprolactone or a linear aliphatic polyester with poly(styrene-co-acrylonitrile) and/or bisphenol A polycarbonate.

EP-A-0 227 094 describes a dye acceptor element based on bisphenol A polycarbonate which, for a molecular weight of the polycarbonate of greater than 25,000, can be processed to layers having very little surface roughness. A polycarbonate receptor layer in which the polycarbonate is synthesized from bisphenol A and non-aromatic diols is known from U.S. Pat. No. 4,927,803.

The products described therein do not contain any polyether segments of relatively high molecular weight. In addition, they are not commercially available and can only be obtained by a method operable solely on a laboratory scale. Accordingly, large-scale application is out of the question.

The dye acceptor layers available at the present time are not yet entirely satisfactory in regard to high color density, adequate image stability and good resolution. It is particularly difficult in this regard to achieve high color density and adequate image stability for minimal lateral diffusion.

The problem addressed by the present invention was to provide a dye acceptor element for thermosublimation printing which would not have any of the disadvantages mentioned above. This problem has been solved by the use of a special polymer in the dye acceptor element.

A dye acceptor element for thermosublimation printing has now been found in which a polyether carbonate (PEC), optionally in admixture with other suitable partners, is used in the dye acceptor layer.

The present invention relates to a dye acceptor element for thermosublimation printing comprising a support and a dye acceptor layer consisting essentially of polycarbonate arranged on the support, wherein the polycarbonate contains from 30 to 95% by weight of aromatic carbonate structural units corresponding to formula I $$[—O—\text{diphen}—X—] \quad (I)$$

in which diphen is the residue of a diphenol containing 6 to 30 and preferably 12 to 24 carbon atoms and X represents —O—CO— and from 70 to 5% by weight of aliphatic polyether carbonate structural units corresponding to formula II $$[—O—\text{polyether}—X—] \quad (II)$$

in which polyether is the residue of an aliphatic polyether diol having a molecular weight Mn of from 600 to 20,000 and preferably of from 4,000 to 10,000 and X represents —O—CO— and wherein optionally up to about 8% by weight and preferably up to about 4% by weight of said diphenol component of formula I have been replaced by $C_{2-15}$ alkane diols and/or $C_5$ or $C_6$ cycloalkane diols and wherein optionally up to about 20 mol-% of the carbonale groups —O—CO—O— have been replaced by aromatic and/or (cyclo)aliphatic dicarboxylate groups.

The polymers used in accordance with the invention in the dye acceptor layer are segmented, aliphatic-aromatic polyether copolycarbonates having a molecular weight $\overline{M}_w$ (weight average) in the range from 20,000 to 350,000 and preferably in the range from 100,000 to 250,000 (as determined by the light scattering method using a scattered light photometer).

Up to about 20 mol-% and preferably up to about 10 mol-% of the carbonate groups —O—CO—O— may optionally be replaced by terephthalate and/or isophthalate groups and/or up to about 10 mol-% and preferably up to about 5 mol-% of the carbonate groups may optionally be replaced by $C_{2-15}$ alkylene dicarboxylate groups and/or $C_5$ or $C_6$ cycloalkylene dicarboxylate groups.

The segmented aliphatic-aromatic polyether copolycarbonates are known (see, for example, DE-A-2 251 066, U.S. Pat. No. 4,160,791, U.S. Pat. No. 4,075,108 and U.S. Pat. No. 4,069,151).

They may be prepared in known manner, for example by the interfacial process, from diphenols $$HO—\text{phen}—OH \quad (III)$$

polyether diphenol carbonates HO—phen—O—CO—O—polyether—O—CO—O—phen—OH and phosgene (cf. DE-A-34 08 804).

The corresponding part of the diphenols HO—phen—OH may be replaced by the $C_{2-15}$ alkane diols or the $C_5$ or $C_6$ cycloalkane diols and used in the form of their bischlorocarbonic acid esters. Similarly, a corresponding part of the phosgene may be replaced by terephthalic acid dichloride, isophthalic acid dichloride and/or the $C_{2-15}$ alkanedicarboxylic acid dichlorides or $C_5$ or $C_6$ cycloalkane dicarboxylic acid dichlorides.

To regulate the molecular weight of the segmented aliphatic-aromatic polyether copolycarbonates, monophenols or aromatic monocarboxylic acid chlorides may be used in known manner in the usual quantities.

The polyether copolycarbonates may be linear or branched in known manner, for example by the incorporation of triphenols.

Diphenols (III) suitable for the purposes of the invention are, for example, bis-(hydroxyphenyl)-alkanes, bis-(hydroxyphenyl)-cycloalkanes and dicycloalkanes, dihydroxydiphenyls,bis-(hydroxyphenyl)-ethers,bis-(hydroxyphenyl)-sulfones, bis-(hydroxyphenyl)-sulfides, bis-(hydroxyphenyl)-ketones, $\alpha,\alpha$-bis-(hydroxyphenyl)-diisopropyl benzenes and nucleus-alkylated compounds thereof.

Preferred diphenols (III) correspond to formula IV

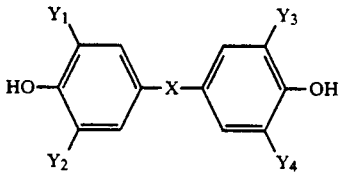

(IV)

in which

X is a single bond, methylene, isopropylidene, cyclohexylidene, oxygen, sulfur, sulfone or carbonyl;

$Y_1$ to $Y_4$ (same or different) represent hydrogen or $C_{1-4}$ alkyl, preferably H or methyl.

Examples of diphenols (III) are 4,4-dihydroxydiphenyl, 2,4'-dihyroxydiphenyl, 4,4'-dihydroxy-3,3'-5,5'-tetramethyl diphenyl, 4,4'-dihydroxy-3,3'-dimethyl diphenyl, bis-(4-hydroxyphenyl)-methane, bis-(4-hydroxy-3,5-dimethyl phenyl)-methane, bis-(4-hydroxyphenyl)-ethane, 2,2-bis-(4-hydroxyphenyl)-propane ("bisphenol A"), 2,2-bis-(4-hydroxy-3,5-dimethylphenyl)-propane, 2,2-bis-(4-hydroxy-3-methylphenyl)-propane, 1,1-bis-(4-hydroxyphenyl)-cyclohexane, 1,1-bis-(4-hydroxy-3,5-dimethylphenyl)-cyclohexane,bis-(4-hydroxyphenyl)-oxide, bis-(4-hydroxy-3,5-dimethylphenyl)oxide, bis-(4-hydroxyphenyl)-ketone, bis-(4-hydroxy-3,5-dimethylphenyl)-ketone, bis-(4-hydroxy-3,5-diethylphenyl)propane,bis-(4-hydroxyphenyl)-sulfone, bis-(4-hydroxy-3,5-dimethylphenyl)-sulfone, bis-(4-hydroxyphenyl)-sulfide and bis-(4-hydroxy-3,5-dimethylphenyl)-sulfide.

Particularly preferred diphenols (III) are 2,2-bis-(4-hydroxyphenyl)-propane ("bisphenol A") and 2,2-bis-(hydroxy-3,5-dimethylphenyl)-propane.

Aliphatic polyether diols suitable for the production of the polyether diphenol carbonates are, preferably, polyethylene glycols such as those of Union Carbide (Carbowax), British Petrol (Breox), Hoechst (Polyglycol) and Hüls (Polywax) having molecular weights (number average molecular weights) in the range from 600 to 20,000 and preferably in the range from 4,000 to 10,000. In addition to the polyethylene glycol mentioned, other hydroxylfunctional polyethers, for example polyethylene oxide/propylene oxide co- and block polyethers, may also be used.

$C_{2-15}$ alkylenediols are, for example, ethylene glycol, propane-1,2-diol, butane-1,4-diol, hexane-1,6-diol, octane-1,8-diol, dodecane-1,12-diol and 1,2-dihydroxydodecane; a suitable cycloalkylene diol is, for example, 1,4-dihydroxycyclohexane; $C_{2-15}$ alkane dicarboxylic acid dichlorides are, for example, succinic acid dichloride, adipic acid dichloride, azelaic acid dichloride, sebacic acid dichloride and dodecane dicarboxylic acid dichloride; suitable cycloalkane dicarboxylic acid dichlorides are, for example, hexahydroterephthaloyl chloride and hexahydroisophthaloyl chloride.

Suitable phenolic chain terminators are any of the usual phenols, such as phenol itself, p-tert. butyl phenol and p-di-tert. octyl phenol, and also monofunctional polyethers while suitable aromatic monocarboxylic acid chlorides are benzoic acid chloride and alkyl benzoic acid chloride.

Preferred ratios of aromatic carbonate structural units (I) to aliphatic polyether carbonate structural units (II) are 30% by weight - 55% by weight (I) to 70% by weight - 45% by weight (II) because, with ratios of this order, the water-spreading effect is present even without the addition of surfactants.

The polyether copolycarbonates to be used in accordance with the invention have relative solution viscosities (as measured on solutions of 0.5 g in 100 ml methylene chloride at 25° C.) of 1.1 to 3.8 and preferably 1.5 to 3.8.

The molecular weights $\overline{M}_n$ (number average) of the polyether diols are determined by gel permeation chromatography and hydroxyl value.

The polyether carbonates may also be used in the form of mixtures with other known resins for dye acceptor layers. For example, the following polymers a) to e)—either individually or in admixture—may be used in combination with the polyether carbonates as dye receptor material:

a) polymers containing ester bonds: polyesters, polyacrylates, polycarbonates, polyvinyl acetate, polyvinyl propionate, styrene acrylates, methyl styrene acrylates, etc.

b) polymers containing urethane bonds: polyurethanes, polyester urethanes, etc.

c) polymers containing amide bonds: polyamides, polyester amides, etc.

d) polymers containing urea bonds: polyureas, etc.

e) polymers containing other highly polar bonds, such as for example polycaprolactone, polystyrenes, polyvinyl alcohol, polyvinyl chloride, polyacrylonitrile, polyethers, polysulfones, polyether ketones, polyhydantoin, polyimides, styrene/MA copolymers, cellulose derivatives, etc.

Examples of such resins can be found, for example, in EP-A-0 227 094, EP-A-0 228 066, EP-A-0 133 011, EP-A-0 133 012 or EP-A-0 144 247.

In cases where the polyether carbonates are used in combination with other resins of the type mentioned above as the dye acceptor layer, the percentage content of the other resins in the mixture as a whole is between 0 and 50% by weight.

High-boiling solvents or plasticizers may also be added to the dye acceptor layer and may provide, for example, for better solubility of the transferred dyes. Useful representatives of these compounds are mentioned, for example, in JP 62/174 754, JP 62/245 253, JP 61/209 444, JP 61/200 538, JP 62/136 646, JP 62/30 274.

Pigments or mixtures of several pigments, such as for example titanium dioxide, zinc oxide, kaolin, clay, calcium carbonate or Aerosil, may be added to the dye acceptor layer, for example to increase image sharpness or to improve whiteness.

If necessary, various types of additives, including for example UV absorbers, light stabilizers or antioxidants, may be added in order further to increase the light stability of the transferred dye.

The dye acceptor layers according to the present invention may contain a lubricant to improve the abhesive properties, primarily between the donor element and the acceptor element. For example, solid waxes, such as polyethylene wax, amide waxes or Teflon powder may be used for this purpose, although fluorine-containing surfactants, paraffin oils, silicone oils or fluorine-containing oils or silicone-containing copolymers, such as polysiloxane/polyether copolymers, may also be used as lubricants.

The lubricants mentioned may even be applied as a separate coating, in the form of a dispersion or from a suitable solvent, optionally as a top coat. The thickness of such a layer is preferably from 0.01 to 5 μm and more preferably from 0.05 to 2 μm.

Various materials may be used as supports for the dye acceptor layers. It is possible to use transparent films, such as for example polyethylene terephthalate, polycarbonate, polyether sulfone, polyolefin, polyvinyl chloride, polystyrene, cellulose or polyvinyl alcohol copolymer films. Reflective supports, such as the various types of papers, for example polyolefin-coated paper or pigmented papers, may of course also be used. Laminates of the materials mentioned above are also suitable supports. Typical combinations are laminates of cellulose paper and synthetic paper or cellulose paper and polymer films or polymer films and synthetic paper or even other combinations.

The supports provide for the necessary mechanical stability of the dye acceptor element. If the dye acceptor layer has sufficient mechanical stability, there may be no need for an additional support.

The dye acceptor layers according to the present invention preferably have overall layer thicknesses of 0.3 to 50 μm and, more preferably, 0.5 to 10 μm where a support of the type described above is used or—in the absence of such a support—3 to 120 μm. The dye acceptor layer may consist of a single layer although two or more layers may also be applied to the support. Where transparent supports are used, they may be coated on both sides to increase color intensity, as described for example in European patent application 90 200 930.7.

The dye acceptor element according to the present invention may also contain various interlayers between the support and the dye receptor layer. Depending on the specific properties of the material used, the interlayer may act as an elastic layer, as a barrier layer for the dye transferred or even as a binder layer, depending on the particular application. Suitable materials are, for example, urethane, acrylate or olefin resins and also butadiene rubbers or epoxides. The thickness of this interlayer is normally between about 1-2 and 20 μm. The function of the diffusion barrier layers is to prevent the transferred dyes from diffusing into the support. Materials which perform this function may be soluble in water or in organic solvents or in mixtures, but preferably in water. Suitable materials are, for example, gelatine, polyacrylic acid, maleic anhydride copolymers, polyvinyl alcohol or cellulose acetate.

The additional layers optionally present, such as the elastic layer, the diffusion barrier layer, the binder layer, etc., and the actual dye acceptor layer may contain, for example, silicate, clay, aluminium silicate, calcium carbonate, calcium sulfate, barium sulfate, titanium dioxide or aluminium oxide powder.

The image acceptor element according to the invention may also be antistatically treated in the usual way on its front or back. In addition, it may be provided with markings, for example on the back of the support, in order to achieve exact positioning during the printing process.

The dye acceptor element according to the invention may be combined with any of the dye donor elements typically used in thermosublimation printing.

The polyether carbonate of Example 1 used in the production of the dye acceptor element according to the invention is marketed by Bayer AG under the name KU 3013. The other polyether carbonates can be similarly produced on a relatively large scale.

The dye images obtained in a thermosublimation printer are distinguished by high resolution, high color densities, high brilliance and good long-term stability.

The polyether carbonate-containing dye acceptor layers are normally produced from solution. Suitable solvents are, for example, methylene chloride, chlorobenzene, THF or dioxolane. The solution may be applied to the support by casting of knife-coating.

EXAMPLES

1. Polyether carbonates

Polyether carbonates are produced from polyethylene oxide and bisphenol A and also phosgene (excess) in the parts by weight shown in Table 1 by the process described in DE-A-34 08 804. To this end, bisphenol A, polyether and sodium hydroxide are initially introduced in a mixture of methylene chloride and water, after which phosgene is introduced in an excess of 150 mol-%, based on bisphenol A. At the same time, sodium hydroxide is introduced in such a quantity that the pH value remains constant at pH 14.

TABLE 1

| Example | Polyether MW 8,000 | Polyether MW 20,000 | BPA-PC |
|---|---|---|---|
| 1 | 20 | — | 80 |
| 2 | — | 20 | 80 |
| 3 | 30 | — | 70 |

2. Dye acceptor layers

The copolycondensates obtained in Examples 1 to 3 were used as follows for the formation of dye acceptor layers:

5% solutions of the polyether carbonates of Examples 1 and 2 and 10% solutions of the product of Example 3 in methylene chloride were prepared. The solutions were knife-coated in a wet film thickness of 20 μm onto a paper which was lined on both sides with polyethylene and to one side of which a gelatine layer was additionally applied over the polyethylene. The polyether carbonate layer was applied to that side. The coatings were dried for 60-minutes at 90° C. in a recirculating air drying cabinet. A 0.5% solution in ethanol of Tego Glide 410 (Goldschmidt) was then applied in a wet film thickness of 24 μm and dried at 70° C. in a recirculating air drying cabinet. Test images were produced on the dye receptor elements obtained with a Mitsubishi CP-100 E video printer using a Mitsubishi CK-100 S dye cassette.

The dye acceptor layers produced from the polyether carbonates according to the invention are distinguished by increased color densities and a greatly reduced tendency towards adhesion.

Color densities determined with a Macbeth RD 919 Densitometer for the pure yellow field of the test image and the adhesion behavior are shown in Table 2.

TABLE 2

| Example | D | Adhesion |
|---|---|---|
| 1 | 0.61 | None |
| 2 | 0.71 | None |
| 3 | 0.86 | Slight |
| 4 | 0.47 | Very pronounced |
| 5 | 0.45 | Very pronounced |

Ex. 4: Comparison Example Makrolon 5700

Ex. 5: Comparison Example Makrolon 3100

Examples 1 to 3 show that the dye acceptor layers produced from the modified polycarbonates have higher color densities and better abhesive properties (less adhesion).

We claim:

1. A thermosublimation dye acceptor element in combination with a sheet-form or web-form donor material containing a sublimatable dye, said acceptor element comprising a support and, coated thereon, a dye acceptor layer consisting essentially of polycarbonate, wherein the polycarbonate contains from 30 to 95% by weight of aromatic carbonate structural units corresponding to formula I

[—O—diphen—X—] (I)

in which diphen is the residue of a diphenol containing 6 to 30 carbon atoms and X represents —O—CO, and from 70 to 5% by weight of aliphatic polyether carbonate structural units corresponding to formula II

[—O—polyether—X—] (II)

in which polyether is the residue of an aliphatic polyether diol having a molecular weight Mn of from 600 to 20,000 and X represents —O—CO—, and wherein optionally up to about 8% by weight of said diphenol component of formula I have been replaced by $C_{2-15}$ alkane diols and/or $C_5$ or $C_6$ cycloalkane diols and wherein optionally up to about 20 mol-% of the carbonate groups —O—CO—O— have been replaced by aromatic and/or (cyclo)aliphatic dicarboxylate groups.

2. A dye acceptor element as claimed in claim 1, wherein the polyether in formula (II) is the residue of an aliphatic polyether diol having a molecular weight Mn of from 4,000 to 20,000.

3. A dye acceptor element as claimed in claim 1, wherein the polycarbonate is a segmented, aliphatic-aromatic polyether copolycarbonate having a molecular weight $\overline{M}_w$ in the range from 20,000 to 350,000.

4. A dye acceptor element as claimed in claim 3, wherein the polycarbonate has a $\overline{M}_w$ in the range from 100,000 to 250,000.

5. A dye acceptor element as claimed in claim 1, wherein, in addition to said polycarbonate, said dye acceptor layer contains at least one of plasticizers, high-boiling solvents and pigments.

6. A dye acceptor element as claimed in claim 1, wherein, in addition to said polycarbonate, said dye acceptor layer contains at least one of UV absorbers, light stabilizers and antioxidants.

7. A dye acceptor layer according to claim 1, wherein, in addition to said polycarbonate, said dye acceptor layer contains at least one lubricant.

8. A dye acceptor layer according to claim 1, wherein said dye acceptor layer has a thickness of from about 0.3 to 50 um.

9. A thermosublimation dye acceptor element in combination with a sheet-form or web-form donor material containing a sublimatable dye, said acceptor element comprising a support and, coated thereon, a dye acceptor layer consisting essentially of polycarbonate wherein the polycarbonate consists of recurring structural units of formula I

[—O—diphen—X—] (I)

in an amount of from 30 to 95% by weight and of recurring structural units of formula II

[—O—polyether—X—] (II)

in an amount of from 70 to 5% by weight wherein diphen is the residue of a diphenol compound containing 6 to 30 carbon atoms or the residue of a mixture of diol compounds consisting of from about 92 to 100 mol-% of said diphenol and from 0 to about 8 mol-% of at least one diol selected from the group consisting of $C_{2-15}$ alkanediols and $C_{5-6}$ cycloalkanediols;

polyether is the residue of an aliphatic polyether diol having a molecular weight Mn of from 600 to 20,000; and X consists of 100-m mol-% of recurring structural units of formula —O—CO— and m mol-% of recurring structural units of formula —O—CO—R—CO— wherein R is a bivalent aromatic or (cyclo)aliphatic group and wherein m is a value of from 0 to 20.

10. A dye acceptor element as claimed in claim 9 wherein in formulae I and II X consists of from 0 to 20 mol-% of recurring structural units of formula —O—CO—R—CO— wherein R is m- and/or p-phenylene.

11. A dye acceptor element as claimed in claim 9 wherein in formulae I and II X consists of from 0 to 10 mol-% of recurring structural units of formula —O—CO—R—CO— wherein R is $C_{2-15}$ alkylene and/or $C_5$ or $C_6$ cycloalkylene.

12. A dye acceptor element as claimed in claim 9 wherein in formula I and II X consists of from 0 to 10 mol-% of recurring structural units of formula —O—CO—R—CO— wherein R is $C_{2-15}$ alkylene and/or $C_5$ or $C_6$ cycloalkylene.

13. A dye acceptor element as claimed in claim 9, wherein the polyether in formula (II) is the residue of an aliphatic polyether diol having a molecular weight Mn of from 4,000 to 20,000.

14. A dye acceptor element as claimed in claim 9, wherein, in addition to said polycarbonate, said dye acceptor layer contains at least one of plasticizers, high-boiling solvents and pigments.

15. A dye acceptor element as claimed in claim 9, wherein, in addition to said polycarbonate, said dye acceptor layer contains at least one of UV absorbers, light stabilizers and antioxidants.

16. A dye acceptor layer according to claim 9, wherein, in addition to said polycarbonate, said dye acceptor layer contains at least one lubricant.

17. A dye acceptor layer according to claim 9, wherein said dye acceptor layer has a thickness of from about 0.3 to 50 um.

* * * * *